US006357283B1

(12) United States Patent
Welling et al.

(10) Patent No.: US 6,357,283 B1
(45) Date of Patent: Mar. 19, 2002

(54) SOUNDING APPARATUS AND METHOD FOR OPERATING IT

(75) Inventors: Engbert Welling; Reijnoud Koelemey, both of Heerenveen (NL)

(73) Assignee: Verenigde Bedrijven Van den Berg Heerenveen Holding B.V., Heerenveen (NL)

( * ) Notice: Subject to any disclaimer, the term of this patent is extended or adjusted under 35 U.S.C. 154(b) by 0 days.

(21) Appl. No.: 09/401,154

(22) Filed: Sep. 22, 1999

(30) Foreign Application Priority Data

Sep. 24, 1998 (NL) ..... 1010178

(51) Int. Cl.[7] ..... G01N 3/00
(52) U.S. Cl. ..... 73/84; 73/594; 73/784
(58) Field of Search ..... 73/594, 784, 12.09, 73/12.12, 38, 584; 181/101

(56) References Cited

U.S. PATENT DOCUMENTS

| | | | | |
|---|---|---|---|---|
| 4,059,008 A | * | 11/1977 | Torstensson | 73/38 |
| 4,382,384 A | * | 5/1983 | Mitchell et al. | 73/594 |
| 4,594,899 A | * | 6/1986 | Henke et al. | 73/784 |
| 5,042,595 A | | 8/1991 | Ladanyi | 73/84 |
| 5,203,824 A | * | 4/1993 | Henke et al. | 73/864.41 |
| 5,404,757 A | | 4/1995 | Soulard | 73/784 |
| 5,931,237 A | * | 8/1999 | Henke et al. | 73/84 |

FOREIGN PATENT DOCUMENTS

| | | |
|---|---|---|
| EP | 0 010 988 | 5/1980 |
| EP | 0 448 462 | 9/1991 |
| EP | 1 065 530 A1 | 1/2001 |
| GR | 476357 | 5/1972 |

* cited by examiner

*Primary Examiner*—Hezron Williams
*Assistant Examiner*—Jacques Saint-Surin
(74) *Attorney, Agent, or Firm*—Stroock & Stroock & Lavan LLP

(57) ABSTRACT

Sounding apparatus for pressing a sounding rod into a piece of ground in order to determine the soil properties at various depths, comprising a sounding rod which is intended to be pressed into a piece of ground; first and second clamping members for alternately clamping the sounding rod in place; first drive means for moving the first clamping member up and down in the longitudinal direction of the sounding rod; in which apparatus the first and second clamping members can be separately actuated between an open position and a closed position; second drive means are provided for moving the second clamping member up and down in the longitudinal direction of the sounding rod; and control means are provided, which are connected to the clamping members and drive means for alternately clamping in place, releasing and moving the respective clamping members up and down.

10 Claims, 3 Drawing Sheets

SOUNDING APPARATUS AND METHOD FOR OPERATING IT

BACKGROUND OF THE INVENTION

The invention relates to a sounding apparatus for pressing a sounding rod into a piece of ground in order to determine the soil properties at various depths, comprising:

a sounding rod which is intended to be pressed into a piece of ground;

first and second clamping members for alternately clamping the sounding rod in place;

first drive means for moving the first clamping member up and down in the longitudinal direction of the sounding rod.

A sounding apparatus of this nature is known from SU-A-476 367. The sounding apparatus described herein comprises a sounding rod with a conical measurement head which is intended to determine soil properties at various depths. In this case, the sounding rod is pressed into a piece of ground in steps (discontinuously). The apparatus comprises a first clamping member which is directly connected to two pistons of a hydraulic system. The pistons are indirectly actuated by means of a gear-rack transmission for each downwards movement. The first clamping member is designed with two tilting bodies which clamp the sounding rod in place during a downwards movement of the first clamping member and release it during an upwards movement. The apparatus furthermore comprises a second clamping member which is designed with two tilting bodies which automatically release the sounding rod during a downwards movement of the sounding rod and clamp it in place in the event of any upwards movement of the sounding rod. The second clamping member is fixedly connected to a frame. The gear wheel comprises a section of approximately a quarter of a circle which is cut out. The hydraulic system is under spring load. Shortly before the end of the downwards movement of the pistons, the cut-out section in the gear-wheel comes to lie opposite the rack. This provides the pistons with the freedom to execute an upwards movement under spring load, during which movement the first clamping member automatically moves into an open position. At the same time, the fixedly arranged second clamping member prevents the sounding rod from being able to carry out an undesired movement back upwards. The sounding apparatus is then ready for the next penetration movement.

A drawback of this known sounding apparatus is that it is only able to carry out discontinuous sounding measurements. The penetration movement of the sounding rod into the soil is always interrupted as soon as the pistons have reached their lowest point and have to carry out an upwards movement before the penetration movement can be continued. Waiting each time for the pistons to return to their uppermost point wastes valuable working time. Even more importantly, during each interruption of the sounding measurement, the soil in the area of the sounding rod is given time to settle. Owing to dissipation effects and the build-up of skin friction, the measurement data from a thin layer of soil are lost each time. Furthermore, the structure of the known sounding apparatus is complex It should be noted that over the course of the years, a number of structures have been designed for carrying out a continuous downwards penetration movement of a sounding rod, using a sounding apparatus. Hitherto, however, no satisfactory solution has been found.

SUMMARY OF THE INVENTION

The object of the invention is to overcome the above-mentioned drawbacks, and in particular to provide a sounding apparatus which is simple to operate and which can be used to carry out both continuous and discontinuous sounding measurements.

This object is achieved according to the invention by means of a sounding apparatus according to claim 1. According to the invention, the sounding apparatus comprises first and second clamping members which can be separately actuated between a closed position, in which a sounding rod is clamped in place, and an open position, in which a sounding rod is released. First drive means are provided for the first clamping member, while second drive means are provided for the second clamping member. Both the first and the second drive means are able to cause the associated clamping members to carry out upwards and downwards movements. The clamping members and the drive means are connected to control means. The control means are able to cause the clamping members to alternately clamp in place and release, and, by means of activation of the associated drive means, to carry out upwards and downwards movements. Since both clamping members can move up and down in a separately controllable manner and can be activated separately with regard to the clamping function, the sounding apparatus can advantageously be employed in multifunctional mode. In particular, it is possible, according to the invention, to carry out reliable continuous sounding measurements. This will be explained in more detail below. The sounding apparatus according to the invention is suitable to be supported on the ground via a frame, but may advantageously also be mounted on any sounding vehicle, for example a caterpillar vehicle. In addition to continuous sounding, the apparatus may furthermore be used for carrying out discontinuous sounding measurements, for taking soil samples and for drilling. The sounding apparatus is also suitable for carrying out sounding measurements underwater, for example on the sea bed, provided that it is equipped with a special underwater drive unit.

Preferred embodiments of the sounding apparatus are defined in claims 2–9.

A method for carrying out a continuous sounding measurement according to the invention is defined in claim 10. In this case, the invention is based on a transfer principle. When the first clamping member, in the clamped position, ends a downwards movement, during which movement a sounding rod which is clamped in place by the first clamping members is pressed into a piece of ground, the second clamping members take over the penetration movement of the sounding rod, by likewise carrying out a downwards movement in the clamped position. At the same time as this latter step, the first clamping members, in the unclamped state, carry out an upwards movement. This results in a continuous penetration rate of the sounding rod. The continuous sounding measurement provides considerable advantages with regard to the quality and quantity of sounding measurements. Since the sounding can now be carried out on a continuous basis, considerable time can be saved. At a continuous penetration rate of 2 cm per second, a daily penetration depth to be measured of 200–250 m, and 50 working weeks per year, it is possible to save 100 hours per year. This provides a considerable cost saving. With regard to the quality of measurement, in practice it has been found that significantly better results are obtained. Advantageously, the measurement results show no trace of dissipation effects or of a build-up of skin friction. This allows measurements to be made more accurately and allows the soil properties to be determined over the entire penetration depth without interruption.

BRIEF DESCRIPTION OF THE DRAWINGS

The invention will be explained in more detail with reference to the appended drawing, in which.

DETAILED DESCRIPTION OF THE PREFERRED EMBODIMENTS

Figures 1, 2:
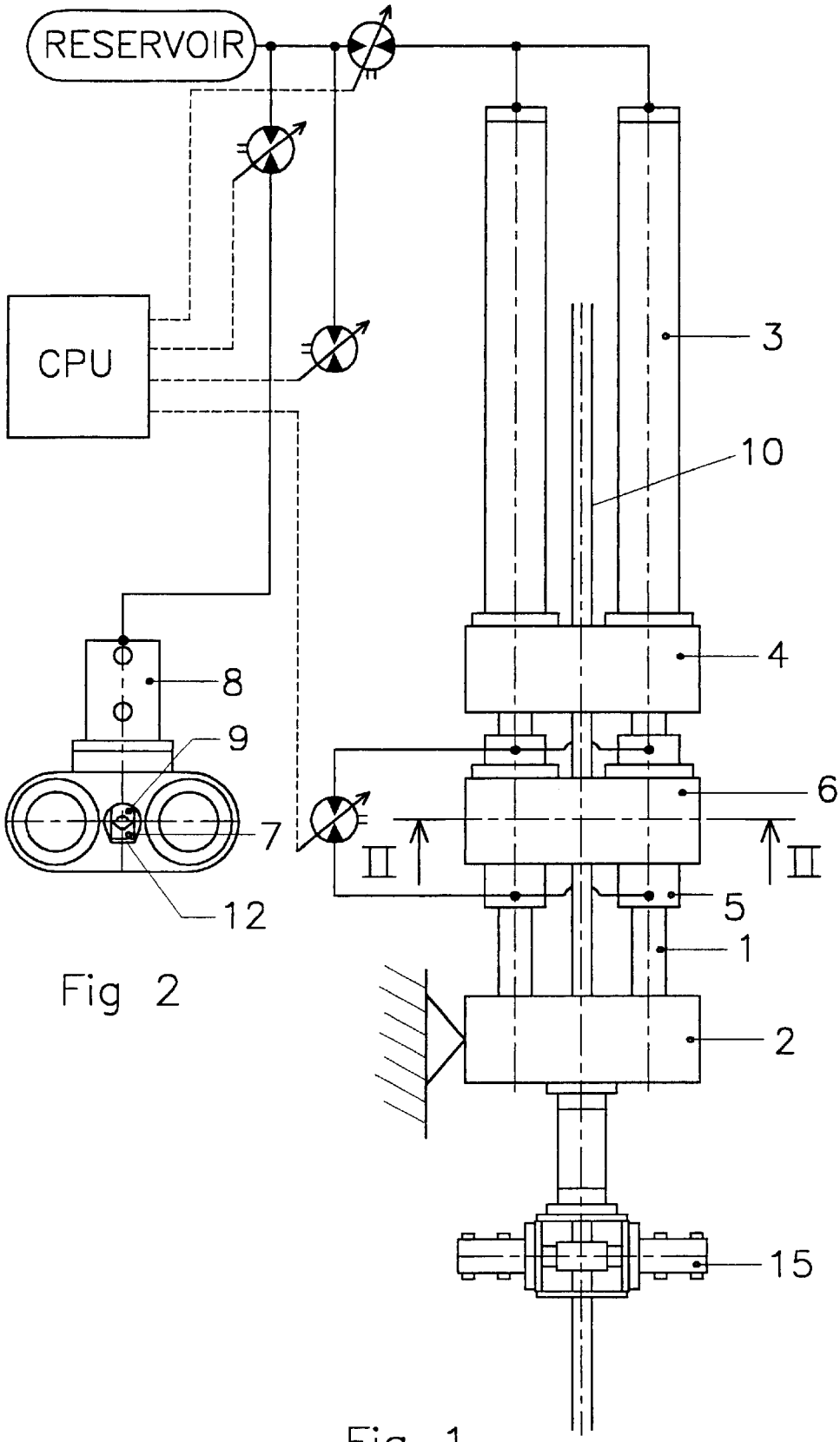
FIG. 1 shows a diagrammatic front view of an embodiment of a sounding apparatus according to the invention.
FIG. 2 shows a view in cross section on line II—II in FIG. 1.

The sounding apparatus which is shown in FIG. 1 comprises two hard chromium plated piston rods I which are disposed next to one another. The piston rods 1 are vertical and are attached to a lower bridge piece 2 on their underside. The lower bridge piece 2 is connected to a fixture, as diagrammatically indicated. The fixture may, for example, be the subframe of a caterpillar vehicle. The device furthermore comprises two cylinder heads 3 which are able to move up and down along the ends of the piston rods 1. At their bottom ends, the cylinder heads 3 are connected to one another by means of an upper bridge piece 4. This results, as it were, in the shape of a rugby goal, with two upwardly projecting posts. The cylinder heads 3 are able to execute an upwards and downwards movement along the piston rods 1 and form first drive means. The two piston rods 1 are longer than is necessary for this movement. On the extended part of the piston rods 1, there are two cylinder sleeves 5. The piston rods 1 extend through the whole of the cylinder sleeves 5. The two cylinder sleeves 5 are connected to one another by means of a central bridge piece 6 which is designed in the same way as the upper bridge piece 4. The cylinder sleeves 5 are able to execute an upwards and downwards movement along the piston rods 1 and form second drive means. For their upwards and downwards movements, the cylinder heads 3 and the cylinder sleeves 5 are hydraulically activated via control means. Advantageously, four limit switches are fitted, which limit the upwards and downwards movements of the cylinder heads 3 and the cylinder sleeves 5 along the piston rods 1. The design with the two piston rods 1 disposed next to one another is robust, stable and reliable.

It can be seen from FIG. 2 that the central bridge piece 6 is provided in the centre with a continuous hole. In this hole, there is a block 7 with a recess which is V-shaped, for example, therein. A hydraulic cylinder 8 is attached to the rear side of the central bridge piece 6. A clamping block 9 with a knurled, shell-shaped recess is mounted on the end of a piston rod of this hydraulic cylinder 8. The blocks 7 and 9 together form a hydraulically actuable clamping member. The clamping member is suitable for clamping rods or tubes of different diameters, for example 36 and 56 mm. To switch over from 36 mm to 56 mm, a filler plate 12 has to be removed. This can be done easily, for example by unscrewing a bolt (not shown), allowing the filler plate 12 to be pulled upwards behind the clamping block 7. The upper bridge piece 4 likewise comprises a hydraulically actuable clamping member which corresponds to the central bridge piece 6.

Since both drive means and both clamping members are hydraulically actuable, the control means may advantageously be of simple design.

The sounding apparatus in FIG. 1 is intended to press a sounding rod, which is denoted by 10 in the figure, into a piece of ground, in order to determine soil properties at various depths. For this purpose, the sounding rod 10 is designed, in a known way, with a measuring probe. The measurement data may be recorded electronically or mechanically and fed to a processing unit. The sounding rod 10 is composed in particular of a plurality of pipe parts which can be connected to one another. In this case, the pipe parts should be connected to one another during an ongoing penetration process, for example by means of a screw connection. A substantial advantage in this case is the open structure between the two cylinder heads 3 located at the top. This provides easier access for an operator.

The sounding apparatus as shown in FIG. 1 furthermore comprises a scraper clamp 15, which is composed of two hydraulic cylinders with shell-shaped blocks on piston rods of the cylinders. The blocks are pressed against the sounding rod 10 and are made in particular from a very wear-resistant plastic. During a sounding measurement, the blocks support the sounding rod 10. While the sounding rod 10 is being pulled back out of the ground, the rod is scraped clean by the blocks of the scraper clamp 15.

Highly advantageously, the sounding apparatus described above is used to carry out a continuous sounding measurement. To this end, the drive means and the clamping members have to be actuated according to a set pattern. This advantageous continuous sounding process will be explained in more detail with reference to FIGS. 3*a, b, c* and *d*.

Figures 3A, 3B, 3C, 3D:
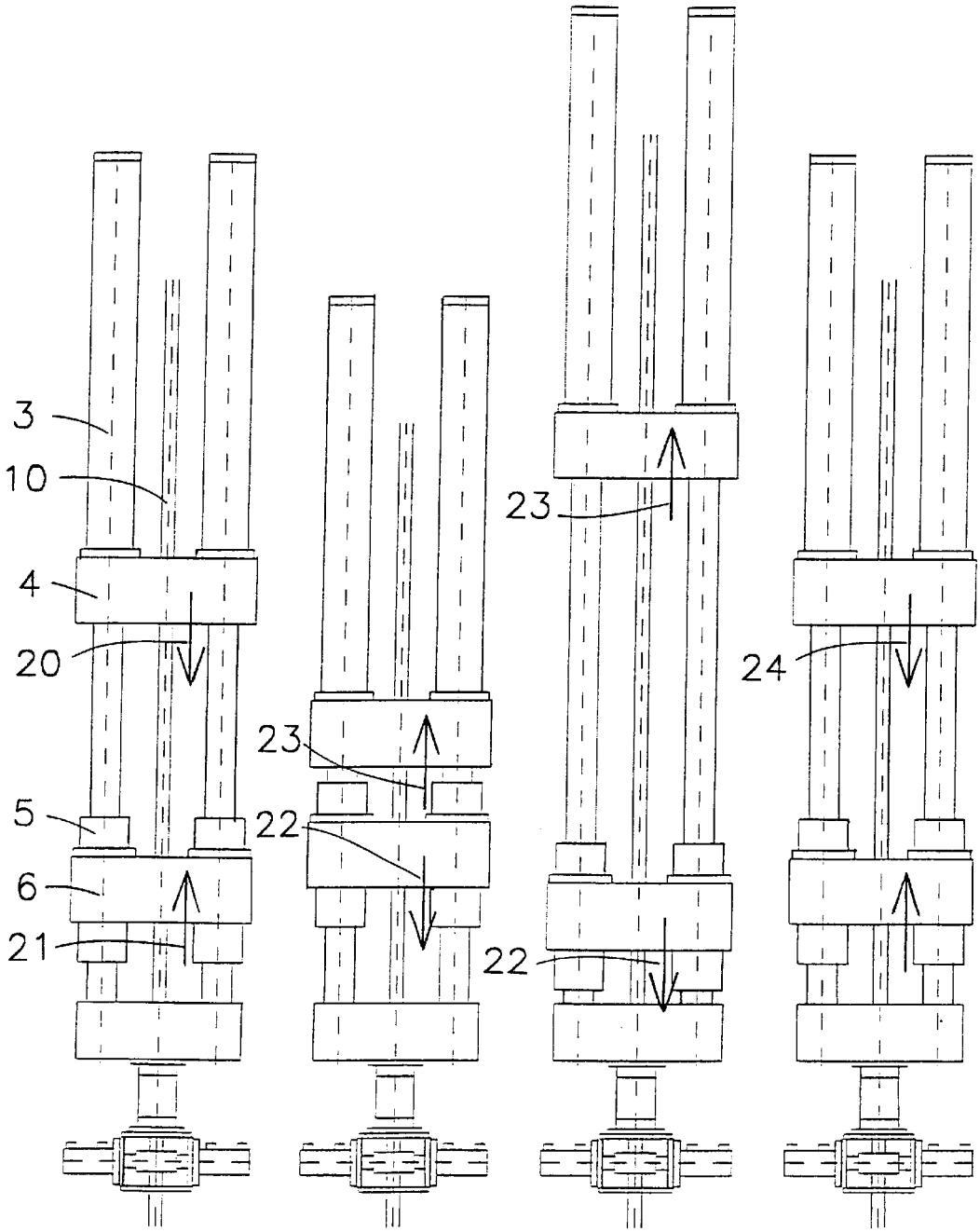
FIGS. 3*a, b, c* and *d* show four respective steps of a continuous sounding measurement using a sounding apparatus as shown in FIG. 1.

In FIG. 3*a*, the upper bridge piece 4, with the first clamping member in the clamped position, as a result of suitable driving of the cylinder heads 3, makes a downwards movement, indicated by arrow 20. As a result, the sounding rod 10 is pressed downwards. At the same time, the centre bridge piece 6, with the second clamping member in the unclamped position, as a result of suitable driving of the cylinder sleeves 5, makes an upwards movement, indicated by arrow 21. Just before the downwards movement of the upper bridge piece 4 reaches its deepest point, the centre bridge piece 7 is also moved downwards. Then, the clamping force is gradually transferred from the first clamping member to the second clamping member. After this has been completed, the second clamping member clamps the sounding rod 10 in place and continues the penetration movement which has been initiated by the first clamping member. This is indicated by arrow 22 in FIGS. 3*b* and 3*c*. The first clamping member in the upper bridge piece 4 is in an unclamped position, and the upper bridge piece 4, in this unclamped position, carries out an upwards movement. This is indicated by arrow 23 in FIGS. 3*b* and 3*c*. Just before the downwards movement of the centre bridge piece 6 reaches its deepest point, the upper bridge piece 4, as a result of corresponding actuation of the cylinder heads 3, is moved back downwards. The clamping force is gradually transferred from the second clamping member to the first clamping member. After this transfer has been completed, the first clamping member clamps the sounding rod 10 in place and continues the penetration movement. This is indicated by arrow 24 in FIG. 3*d*. The cycle is then repeated from the beginning. Suitable activation of the clamping members and drive means, as described above with reference to FIG. 3, results in a kind of transfer principle, making it possible to press the sounding rod into a piece of ground at a substantially continuous rate.

The penetration depth of the sounding rod can be recorded in various ways. One option is a wheel which is coupled to a pulse generator, which wheel is pressed against the sounding rod, for example by means of a spring or a pneumatic cylinder. The number of revolutions of the pulse-generator wheel defines the penetration depth of the sounding rod.

While the sounding rod which is composed of a plurality of pipe parts may be pressed continuously into a piece of ground, the sounding rod is in principle pulled out of the ground in a discontinuous manner. The sounding rod is pulled out at a greater speed, for example 16 cm per second, compared to 2 cm per second for penetration. With such a high withdrawal rate, a continuous upwards movement of the sounding rod would not leave sufficient time for the various pipe parts to be unscrewed. The sounding rod parts can be pulled out of the ground as follows:

the centre bridge piece 6 remains in the upper position during withdrawal;

the first clamping member in the upper bridge piece 4 is closed;

the second clamping member in the centre bridge piece 6 is opened;

the upper bridge piece 4 moves upwards in the clamped position and pulls the sounding rod 10 out of the ground;

the upper bridge piece 4 stops at the end of its travel;

the second clamping member in the centre bridge piece 6 closes;

the first clamping member in the upper bridge piece 4 opens;

the upper bridge piece 4 moves downwards in the unclamped position;

the cycle is repeated from the beginning.

Figure 4:
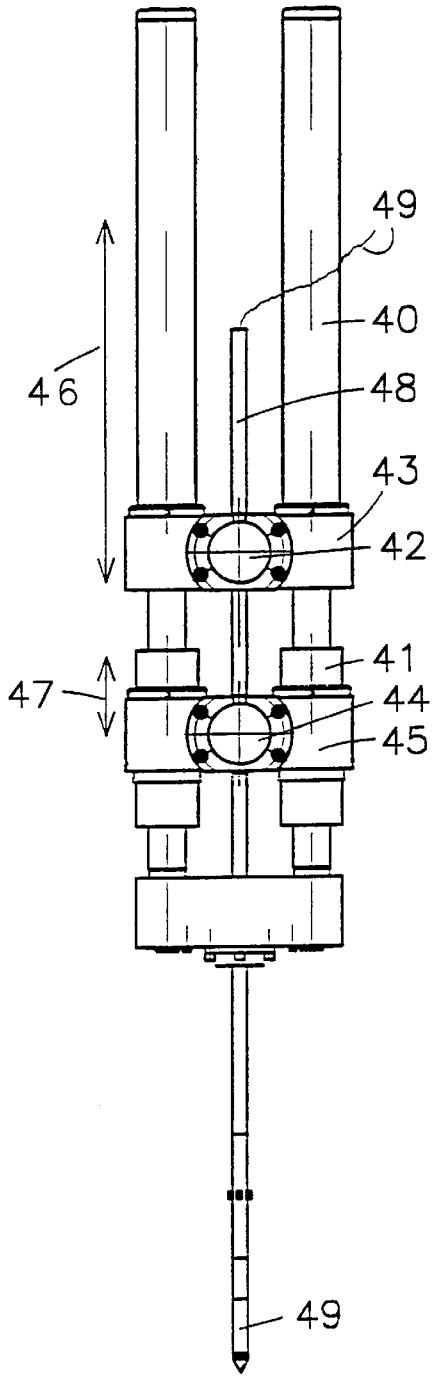
FIG. 4 is a rear view of a sounding apparatus for a continuous sounding process, with an electrical cone.

According to a significant feature of the invention, the drive means of the cylinder heads 40 and the cylinder sleeves 41, as well as the dimensions thereof, are designed in such a way, or else limiting means are arranged at such positions, that the first clamping member 42 in the upper bridge piece 43 is able to make a movement which is many times greater than the movement which the second clamping member 44 in the centre bridge piece 45 is able to make. This is illustrated in FIG. 4, in which the upper movement arrow 46 is more than four times longer than the lower movement arrow 47, for example amounting to 800 and 200 mm respectively. As a result, the accessibility of the sounding rod 48 during a sounding measurement is high, and new pipe parts are advantageously simple to screw on.

It can be further seen from FIG. 4 that a measurement cable 49 extends through a recess in the sounding rod 48. This makes the sounding apparatus shown in FIG. 4 suitable for electrical sounding. For this purpose, the sounding rod 48 is designed with an electrical measurement cone 49'. The pipe parts which are to be screwed onto the sounding rod 48 which has already been shown have, as a preparatory measure, already been pushed over the measurement cable 49 and can be stored at the side of the sounding apparatus.

Figure 5:
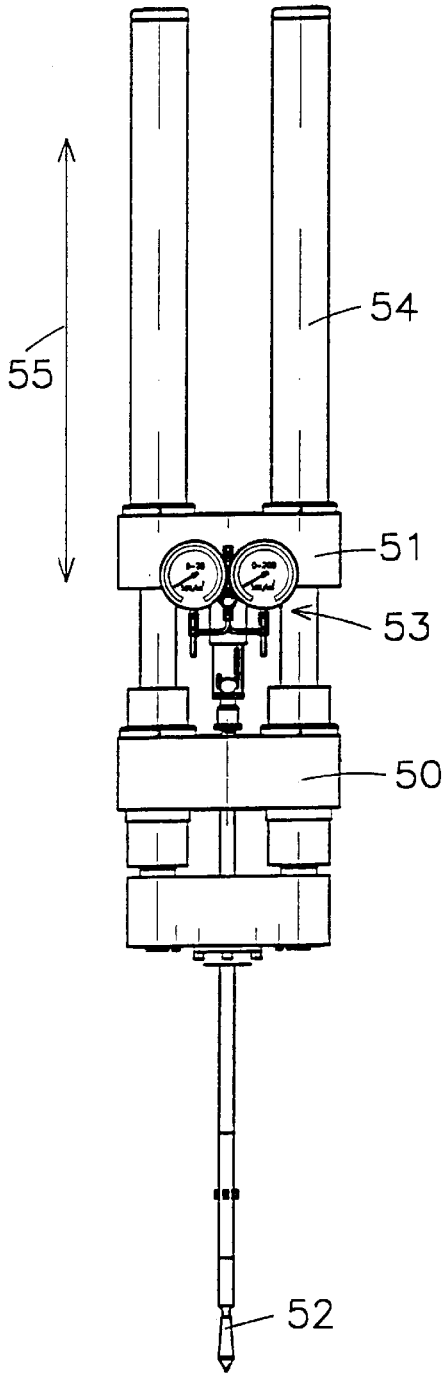
FIG. 5 shows a front view of a sounding apparatus for a discontinuous sounding process, with a mechanical cone.

By dint of its design, the sounding apparatus according to the invention is multifunctional. In addition to the advantageous method described above for carrying out continuous sounding measurements, it is also possible to carry out a discontinuous sounding measurement. During a discontinuous sounding measurement, by way of example, the cylinder sleeves are not actuated and the second clamping member remains in a constant position. By driving the cylinder heads in combination with a suitable alternating actuation of the first and second clamping members, a sounding rod can be pressed into a piece of ground in steps. This is shown in FIG. 5. In this case, the centre bridge piece 50 is fixed in its lowermost position. A sounding rod with a mechanical cone 52 at its bottom end and a hydraulic or electrical measurement appliance 53 at its top end, is clamped in place in the first clamping member of the upper bridge piece 51. Only the upper bridge piece 51 executes upwards and downwards movements of, for example, 1 m, indicated by arrow 55, as a result of the cylinder heads 54 being actuated. After each downwards movement, the upper bridge piece 51 is firstly placed in its uppermost position, after which a new pipe section can be screwed on. Then, a sounding measurement over a limited penetration depth can again be carried out.

Thus, the invention provides a multifunctional sounding apparatus, by means of which it is possible, in particular, to carry out continuous sounding measurements on the basis of a transfer system with two clamping members which can move up and down and can be actuated with regard to clamping.

What is claimed is:

1. A sounding apparatus for pressing a sound rod into a piece of ground in order to determine the soil properties at various depths, comprising:

a sounding rod which is intended to be pressed into a piece of ground;

first and second clamping members for alternately clamping the sounding rods in place, wherein the first and second clamping members are separately actuable between an open position and a closed position;

first drive means for moving the first clamping member up and down in the longitudinal direction of the sounding rod;

second drive means are provided for moving the second clamping member up and down in the longitudinal direction of the sounding rod;

and control means are provided, which are connected to the clamping members and drive means for alternatively clamping in place, releasing and moving the respective clamping members up and down.

2. Sounding apparatus according to claim 1, in which limiting means are provided, in such a position that the first drive means are able to make the first clamping member carry out a movement which is greater than a movement which the second drive means are able to make the second clamping member carry out.

3. Sounding apparatus according to claim 1, in which the drive means are hydraulically actuated piston-cylinder systems, to which the clamping members are connected.

4. Sounding apparatus according to claim 3, in which the first and second drive means comprise at least one common piston rod with cylinder parts which can move along it.

5. Sounding apparatus according to claim 4, in which the first and second drive means comprise two common piston rods which are disposed next to one another and along which the respective cylinder parts move, and bridge pieces are arranged between the respective cylinder parts, to which bridge pieces the clamping members are connected.

6. Sounding apparatus according to claim 4, in which the first drive means comprise a cylinder head which can be moved along an end of the piston rod, and the second drive means comprise a cylinder sleeve which is movable along a centre section of the piston rod.

7. Sounding apparatus according to claim 1, in which the clamping members are hydraulically actuable.

8. Sounding apparatus according to claim 1, in which the clamping members are adjustable with regard to the diameter of the sounding rod.

9. Sounding apparatus according to claim 1, in which the control means are designed to allow the first clamping member, in the closed position, to carry out a downwards movement, and to allow the second clamping member, in the closed position, to carry out a downwards movement just before this downwards movement of the first clamping member ends, with the result that a sounding rod penetrates into a piece of ground at a substantially continuous penetration rate.

10. Method for pressing a sounding rod into a piece of ground using a sounding apparatus according to claim 1, in which a sounding cycle comprises the following steps:

the first clamping member is moved into a clamped position and the second clamping member is moved into an unclamped position;

in the clamped position, the first clamping member makes a downwards movement;

in the unclamped position, the second clamping member makes an upwards movement;

just before the end of the downwards movement of the first clamping member, the second clamping member is moved downward;

the second clamping member is moved into a clamped position, and the first clamping member is moved into an unclamped position;

in the clamped position, the second clamping member makes a downwards movement;

in the unclamped position, the first clamping member makes an upwards movement;

just before the end of the downwards movement of the second clamping member, the first clamping member is moved downwards; and the cycle is repeated from the beginning.

* * * * *